US010081972B1

(12) United States Patent
Kunz

(10) Patent No.: US 10,081,972 B1
(45) Date of Patent: Sep. 25, 2018

(54) VERSATILE AND ECONOMIC ANCHOR MOUNT FOR A COIL SPRING IN A WINDOW COUNTERBALANCE ASSEMBLY

(71) Applicant: John Evans' Sons, Inc., Lansdale, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 0 days.

(21) Appl. No.: 15/679,152

(22) Filed: Aug. 16, 2017

(51) Int. Cl.

| | |
|---|---|
| ***E05F 1/00*** | (2006.01) |
| ***E05D 13/00*** | (2006.01) |
| ***E05D 5/02*** | (2006.01) |
| ***E05D 15/16*** | (2006.01) |

(52) U.S. Cl.
CPC ..... *E05D 5/02* (2013.01); *E05D 13/1276* (2013.01); *E05D 15/165* (2013.01)

(58) Field of Classification Search
CPC ... Y10T 16/197; Y10T 16/64; Y10T 16/6298; Y10T 16/65; E05D 5/02; E05D 13/10; E05D 13/12; E05D 13/1276; E05D 13/1284; E05D 13/1292; E05D 15/165; E05Y 2900/148; E06B 3/44; E06B 3/4407; E06B 3/4415
See application file for complete search history.

(56) References Cited

U.S. PATENT DOCUMENTS 2,635,282 A * 4/1953 Trammell, Sr. ..... E05D 13/1292 16/197
2,732,594 A 1/1956 Adams
3,160,914 A * 12/1964 Brienza ..... E06B 3/44 16/206
3,478,384 A * 11/1969 Skolnik ..... E05D 13/1253 16/197
4,078,336 A * 3/1978 Prosser ..... E05D 13/1207 49/445
4,190,930 A * 3/1980 Prosser ..... E05D 13/1207 16/197
5,353,548 A 10/1994 Westfall
5,463,793 A 11/1995 Westfall
5,661,927 A 9/1997 Polowinczak et al.
6,745,433 B2 * 6/2004 Newman ..... E05D 13/1207 16/202
6,892,494 B2 * 5/2005 Malek ..... E05D 15/22 49/181
6,990,710 B2 1/2006 Kunz
7,735,191 B2 1/2010 Tuller
RE45,328 E 1/2015 Tuller
(Continued)

*Primary Examiner* — Chuck Y Mah
(74) *Attorney, Agent, or Firm* — LaMorte & Associates P.C

(57) ABSTRACT

An anchor mount system for anchoring a free end of a ribbon coil spring to a guide track of a window. The ribbon coil spring has an opening formed through its structure at a first distance from the free end. The anchor mount has a body with a first section and a second section. A first tab and a second tab protrude from the second section of the body. The second tab is angled toward said first tab at an inclined angle. A second distance exists between the first tab and the second tab. This second distance is generally equal to the first distance along the ribbon coil spring. This enables the end of the ribbon coil spring to become entrapped between the tabs when engaged with the tabs and manipulated in a certain manner.

18 Claims, 7 Drawing Sheets

(56) References Cited

U.S. PATENT DOCUMENTS

| | | | | |
|---|---|---|---|---|
| 9,458,655 | B2 | 10/2016 | deNormand | |
| 2004/0163209 | A1 | 8/2004 | Pettit | |
| 2005/0091791 | A1* | 5/2005 | Kunz | E05D 13/08 16/216 |
| 2005/0229492 | A1 | 10/2005 | Robertson | |
| 2009/0119874 | A1* | 5/2009 | Kellum, III | E05D 13/1253 16/197 |
| 2014/0208653 | A1* | 7/2014 | Sofianek | E05D 13/1276 49/150 |
| 2014/0331561 | A1* | 11/2014 | Baker | E05D 13/1276 49/417 |
| 2015/0368952 | A1* | 12/2015 | Baker | E05D 13/1276 49/421 |
| 2017/0292303 | A1* | 10/2017 | Lucci | E05D 13/1276 |

* cited by examiner

VERSATILE AND ECONOMIC ANCHOR MOUNT FOR A COIL SPRING IN A WINDOW COUNTERBALANCE ASSEMBLY

BACKGROUND OF THE INVENTION

1. Field of the Invention

In general, the present invention relates to counterbalance systems for windows that prevent open window sashes from closing under the force of their own weight. More particularly, the present invention system relates to counterbalance systems that use coil springs and the mechanisms used to anchor the free ends of the coil springs to the window frame.

2. Description of the Prior Art

There are many types of windows that are used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, the same system is used to hold a window sash up once it is opened. If no system is used, gravity causes the sash of the window to close as soon as it is opened and released.

In low quality windows, friction between the window sash and the window frame is relied upon to hold a sash open. Such a system is highly unreliable because the friction relied upon varies as parts wear, expand, contract and are painted. It is for this reason that most single and double-hung windows are manufactured with counterbalance systems.

Early window sash counterbalance systems were simply weights that were attached to the sash. The weights were attached to a sash by a rope or chain that passed over a pulley at the top of the window frame. Such counterbalance systems required window wells in which the weights moved. Accordingly, such windows were difficult to insulate. Additionally, the rough opening needed for the window had to be much larger than the window sashes. Furthermore, window sashes attached to such counterbalance systems could not be tilted for cleaning or otherwise removed from the window frame.

Recognizing the many disadvantages of window well counterbalance systems, windows were manufactured with spring-loaded counterbalance systems. Spring-loaded counterbalance systems relied upon the pulling strength of a spring, rather than a hanging weight, to counterbalance the weight of a window sash. Accordingly, window wells for weights were no longer required.

Some of the most popular counterweight systems for double-hung windows utilize coil springs. Coil springs are flat ribbon springs that are wound into coils. Counterbalancing a window sash with a coil spring is a fairly simple matter. The free end of the coil spring is attached to the window frame while the body of the coil spring is engaged by the sash so it moves with the sash. As the sash moves, the coil spring moves, therein causing the coil spring to wind or unwind.

The part of the coil spring that moves with the sash is often held in a brake shoe or spring carriage that connects to the window sash. This enables the coil spring to both wind and unwind while the coil spring moves with the sash. In the prior art, there are many types of coil springs being used in different counterweight systems. Coil springs from different manufacturers may have free ends with different shaped terminations. Some coil springs have free ends with holes to receive anchor screws. Other coil springs may terminate with T-shaped ends or hooked ends in order to engage some type of specialty spring anchor mount. If a coils spring ever kinks or otherwise needs to be replaced, the exact model coil spring needs to be found so that the coil spring will have the proper length, width, coil diameter and anchor termination to fit the system. This has proven problematic since styles and models of counterbalance systems often change over the years.

Additionally, in many counterbalance systems, the coil springs are held in a spring carriage. The free ends of the coil springs are attached to a spring mount. The spring mount is temporarily attached to the spring carriage to form a single assembly. The single assembly is easy to ship and install into the guide track of a window frame. The spring anchor is separated from the spring carriage as the counterbalance system is being installed. Such prior art systems are exemplified by U.S. Pat. No. 7,735,191 to Tuller and U.S. Pat. No. RE45,328 to Tuller.

One of the problems associated with such prior art systems is that the coil spring merely engages a hook on the anchor mount. The spring will remain engaged with the hook on the anchor mount only for as long as the coil spring remains in tension. Normally, a properly installed coil spring is always in tension. However, as a window wears and the recoil time of a coil spring slows, it becomes possible to open a window sash more rapidly than the coil spring can rewind. This momentarily causes the coil spring to be in compression. This can cause the free end of the coil spring to detach from the anchor mount and rewind into the spring carriage where it becomes inaccessible. The counterbalance system is then inoperable and requires repair.

A need therefore exists in the field of window counterbalance systems for an improved spring anchor mount that is reliable and firmly anchors the free end of a coil spring both when the coil spring is in tension and when it is in compression. A need also exists for an improved spring anchor mount that is easy to install both retroactively and in new window installations. Lastly, a need exists for a versatile coil spring anchor mount that is inexpensive to produce and is capable of engaging the free ends of multiple types of coil springs. These needs are met by the present invention as described and claimed below.

SUMMARY OF THE INVENTION

The present invention is an anchor mount system for anchoring a free end of a ribbon coil spring to a guide track of a window. The ribbon coil spring has an opening formed through its structure at a first distance from the free end. This opening and the free end are engaged by the anchor mount.

The anchor mount has a body with a first section and a second section. At least one screw hole is formed through the first section. A first tab protrudes from the second section of the body. The first tab has a first base. Likewise, a second tab protrudes from the second section of the body. The second tab has a second base. Furthermore, the second tab is angled toward said first tab at an inclined angle.

A second distance exists between the first base of the first tab and the second base of the second tab. This second distance is generally equal to the first distance along the ribbon coil spring. This enables the end of the ribbon coil spring to become entrapped between the tabs when engaged with the tabs and manipulated in a certain manner.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the spring anchor mount of the present invention can be used to anchor a coil spring in many types of windows and using different window sash counterbalance systems, the spring anchor mount is illustrated in only a few exemplary applications. The exemplary applications show some of the best modes contemplated for the invention. However, the illustrated embodiments are intended to show only examples and should not be considered limitations when interpreting the scope of claims. It will be understood that the present invention spring anchor mount can be used in most any application where it is intended to anchor one end of a flat ribbon coil spring to the guide track of a window.

Figure 1:
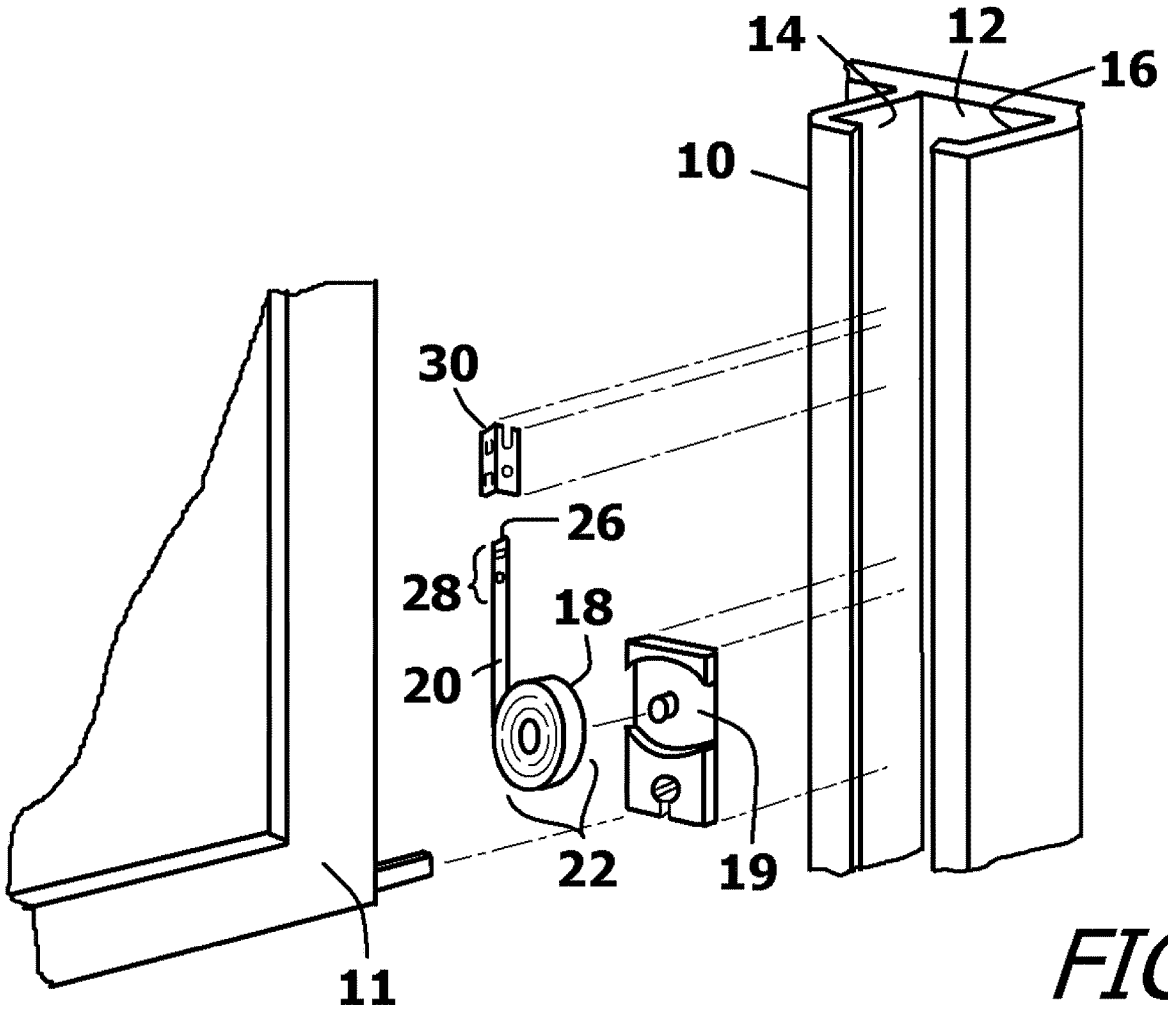
FIG. 1 is a fragmented perspective view of an exemplary embodiment of a counterbalance system for a window.
Figure 2:
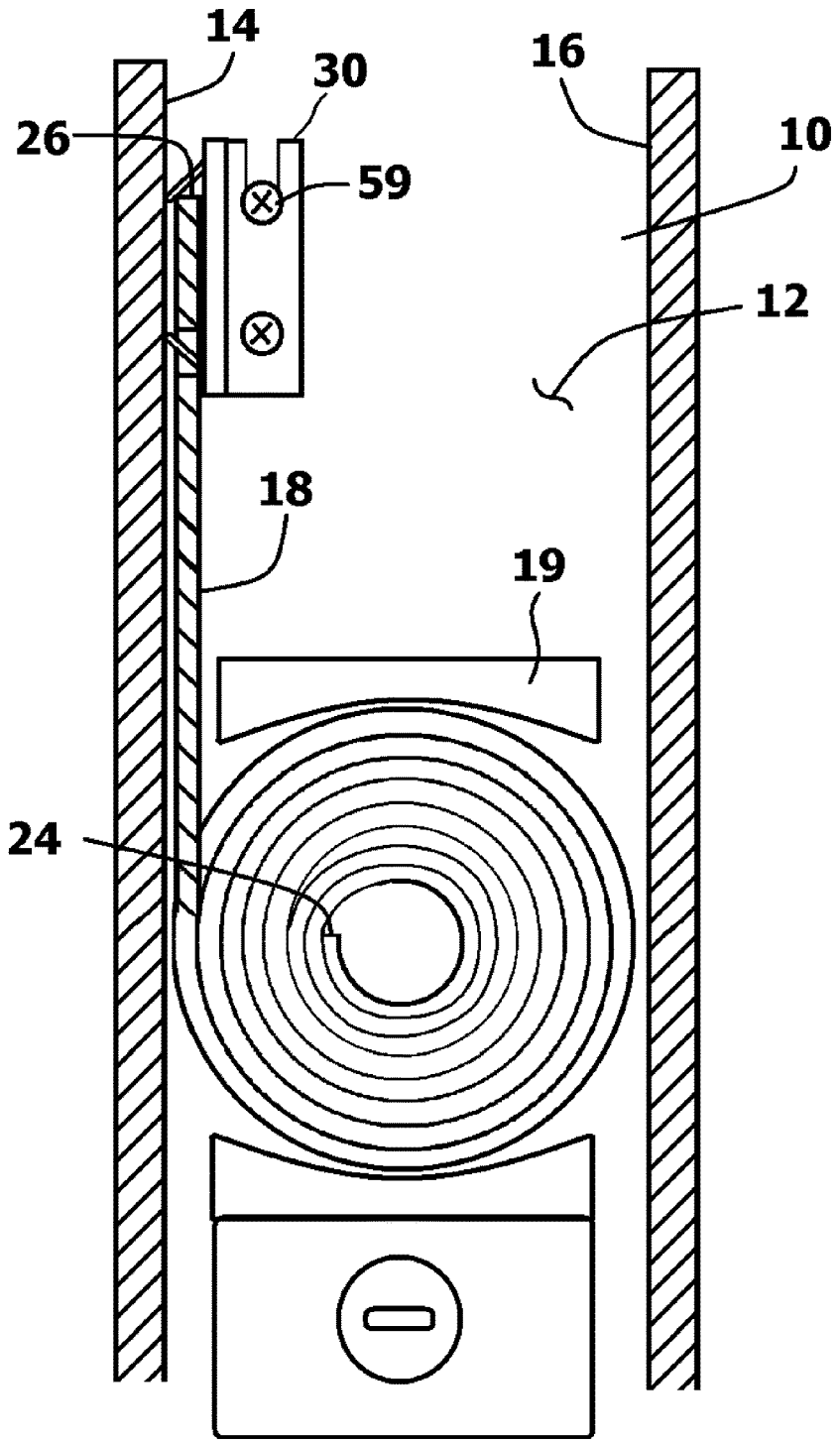
FIG. 2 is an enlarged partially cross-sectioned view of a segment of the exemplary counterbalance system shown in FIG. 1.

Referring to FIG. 1 and FIG. 2, a segment of a guide track 10 is shown. The guide track 10 is formed in a window frame on the sides of the window sash 11. The guide track 10 often has an extruded plastic construction. However, aluminum and wood guide tracks also exist depending upon the make and model of the window. The guide track 10 has a rear wall 12 and two opposite side walls 14, 16. The guide track 10 retains components of the window counterbalance system, such as a coil spring 18 and a spring carriage 19. Depending on the model of the window and the counterbalance system being used, it may be required to anchor the coil spring 18 to either the rear wall 12 or to one of the side walls 14, 16 within the guide track 10.

The coil spring 18 is a wound coil of a metal ribbon 20 that is biased into a coiled configuration 22. Accordingly, the coil spring 18 resists being unwound from the coiled configuration 22. The metal ribbon 20 of the coil spring 18 has two ends 24, 26. When the metal ribbon 20 is wound into the shape of the coiled configuration 22, its first end 24 is located on the interior of the coiled configuration 22. The second end of the metal ribbon 20, herein referred to as the free end 26, terminates on the exterior of the coiled configuration 22.

The free end 26 of the metal ribbon 20 terminates with some type of connector configuration 28. The connector configuration 28 is designed to assist in the mounting of the coil spring 18 to the guide track 10, either directly or through the use of a specialized anchor mount, depending on the model of counterbalance system being used.

Figure 3:
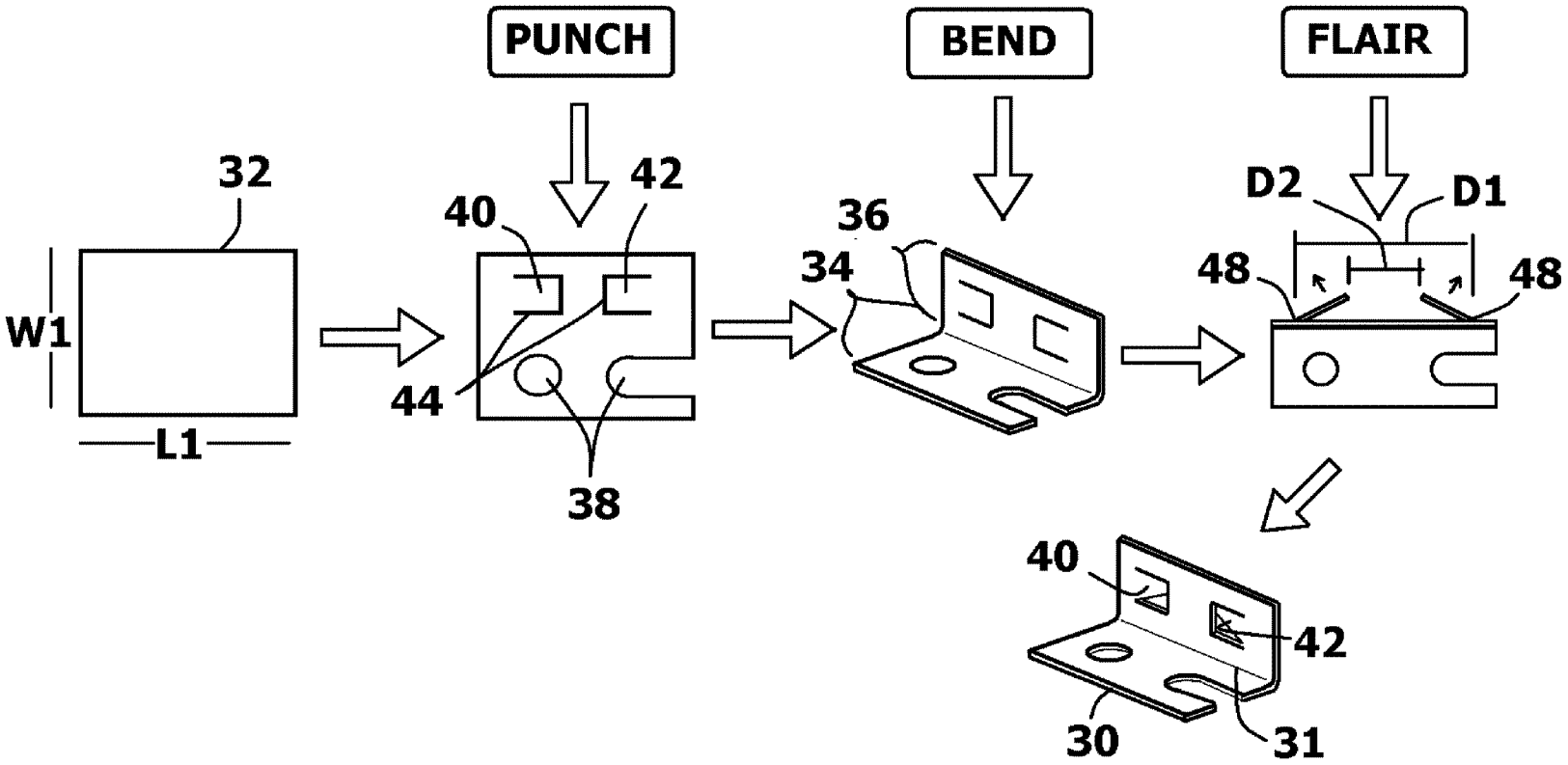
FIG. 3 is a process flow diagram that illustrates the fabrication of an exemplary anchor mount.
Figure 4:
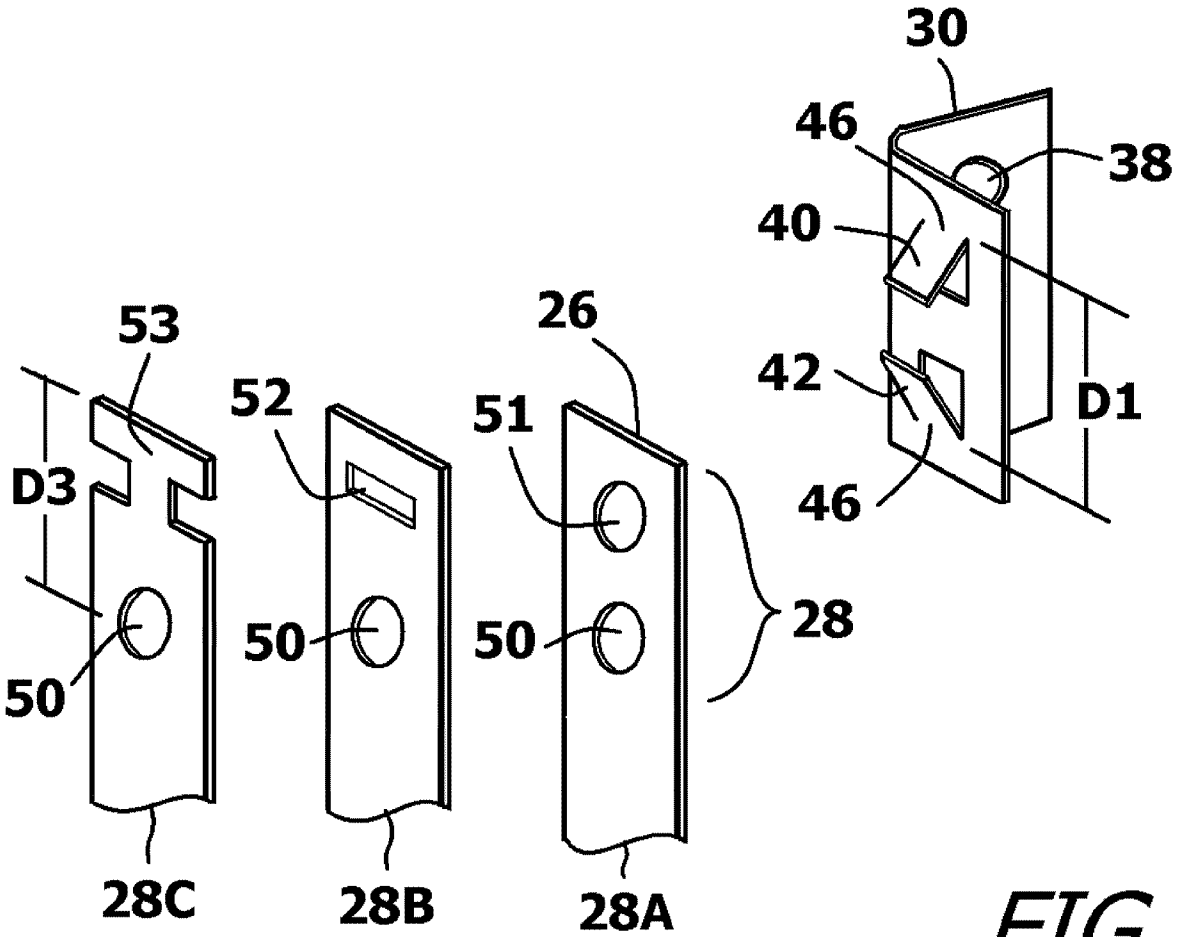
FIG. 4 shows the exemplary anchor mount in conjunction with three types of coil spring terminations.

Referring to FIG. 3 and FIG. 4, it will be understood that the present invention anchor mount 30 has a shaped bracket body that is stamped from a metal blank 32. The metal blank 32 is rectangular in shape having a thickness of between 0.010 inches and 0.030 inches with 0.015 inches being preferred. The length L1 is between 0.75 inches and 1.25 inches long, with 1 inch being preferred. The preferred width W1 is between 0.4 inches and 1.0 inch, with 0.8 inches being preferred. The metal blank 32 is bent into an L-shaped profile across its width. The bend produces a first section 34 and a second section 36 that are perpendicular. The first section 34 is preferably about fifteen percent wider than the second section 36. Accordingly, for the preferred width W1 of 0.8 inches, the first section 34 would have a width of 0.43 inches and the second section 36 would have a width of 0.37 inches.

Two screw holes 38, in the form of circular holes and/or slots, are punched or otherwise formed into the first section 34 of the metal blank 32. This can be done either before or after bending. The screw holes 38 are sized to receive mounting screws, as will later be explained. Although two screw holes 38 are shown, it will be understood that one hole or multiple holes can be used. The number of screw holes 38 and the type of screw hole 38 is dictated by the size of the mountings screws to be used and the area available on the first section 34.

Two tabs 40, 42 are formed in the second section 36 of the metal blank 32. The tabs 40, 42 are created by punching two generally U-shaped cuts 44 in the second section 36. This defines three sides of each of the tabs 40, 42. A base 46 on each of the tabs 40, 42 remains attached to the metal blank 32. Each of the tabs 40, 42 are then flared at their bases 46 to orient each of the tabs 40, 42 at an ascending angle of between thirty degrees and sixty degrees. The tabs 40, 42 are formed in opposing directions. In this manner, each of the tabs 40, 42 ascends at opposite intersecting angles. This creates a first distance D1 between the bases of the tabs 40, 42 and a second distance D2 between the tips of the tabs 40, 42.

Referring to FIG. 4, it can be seen that the connector configuration 28 approaching the free end 26 of a coil spring 18 can have many forms. Three of the most common forms are shown. In the first form 28A, there is a screw hole 51 and a lower opening 50 formed proximate the free end 26 of the coil spring 18. In the second form 28B, there is a rectangular slot 52 and a lower opening 50 formed proximate the free end 26 of the coil spring 18. In the third form 28C, there is a T-shaped head 53 and a lower opening 50 proximate the free end 26 of the coil spring 18. Other terminations also exist. The common feature in the connector configuration 28 is the presence of the lower opening 50 at a distance D3 from the free end 26. The distance D3 between the lower opening 50 and the free end 26 corresponds to the distance D2 between the bases 46 of the two tabs 40, 42 on the anchor mount 30.

Figure 5:
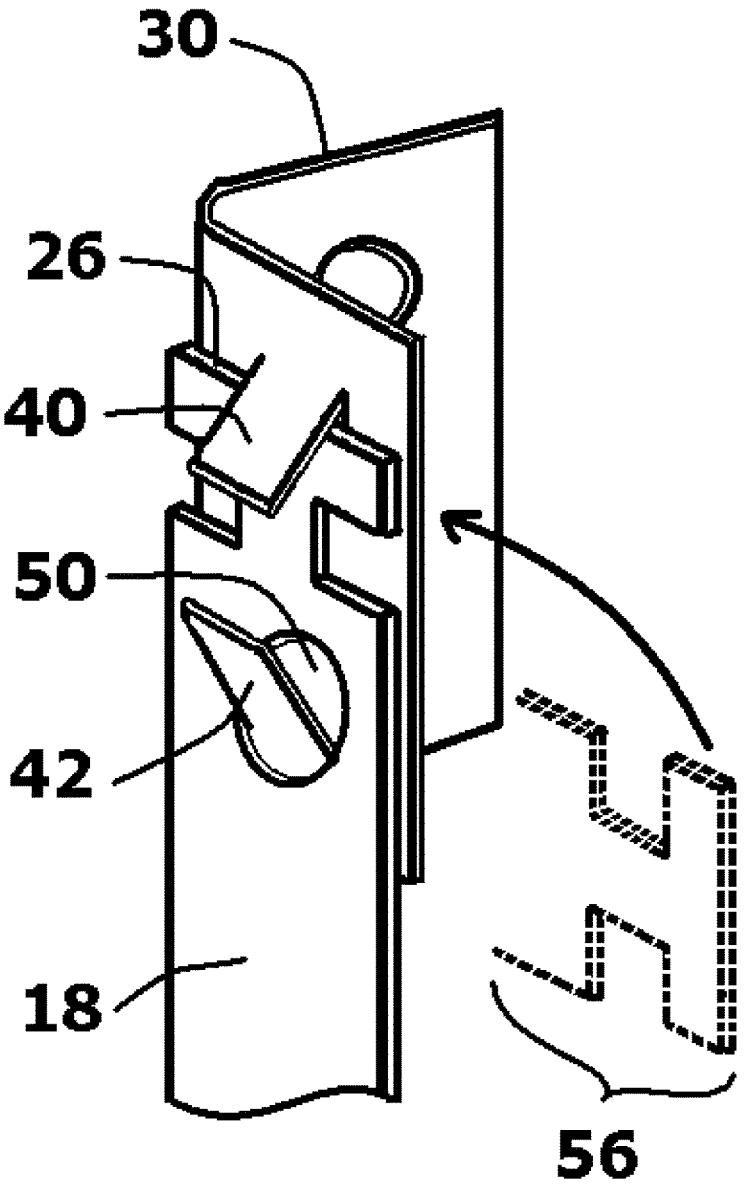
FIG. 5 shows the exemplary anchor mount engaging a coil spring termination.

Referring to FIG. 5 in conjunction with FIG. 4, it can be seen that in order to join the free end 26 of a coil spring 18 to the anchor mount 30, a person first inserts one of the tabs 40, 42 that projects from the anchor mount 30 into the lower opening 50 on the coil spring 18. The segment 56 of the coil spring 18 between the lower opening 50 and the free end 26 is then rotated using the tab 42 as a pivot pin. The coil spring 18 is rotated until the free end 26 of the coil spring 18 is positioned under the first tab 40. In this position, the free end 26 of the coil spring 18 is near the base 46 of the first tab 40 and the first tab 40 extends over the free end 26. The result is that the free end 26 of the coil spring 18 becomes locked in place. The coil spring 18 cannot be detached from the anchor mount 30 merely by placing the coil spring 18 in either tension or compression. Nor can the coil spring 18 detach from the anchor mount 30 by rapidly changing between tension and compression. Rather, the only way to detach the coil spring 18 from the anchor mount 30 is to rotate the coil spring 18. Such a manipulation is not possible if the anchor mount 30 and the coil spring 18 are properly installed within the guide track 10.

Returning to FIG. 2 in conjunction with FIG. 5, it will be understood that the coil spring 18 can be attached to the anchor mount 30 prior to being inserted into the guide track 10. The anchor mount 30 is attached to either the rear wall 12 or to one of the side walls 14, 16 of the guide track 10 depending upon the desired orientation of the coil spring 18 and the requirements of the counterbalance system. The anchor mount 30 is locked into position using screws 59 that pass through the screw holes 38 and engage the guide track 10. Once the anchor mount 30 is mounted within the guide track 10, the manipulations needed to detach the anchor mount 30 from the coil spring 18 cannot be achieved accidentally. As such, the coil spring 18 cannot inadvertently detach from the anchor mount 30.

Figure 6:
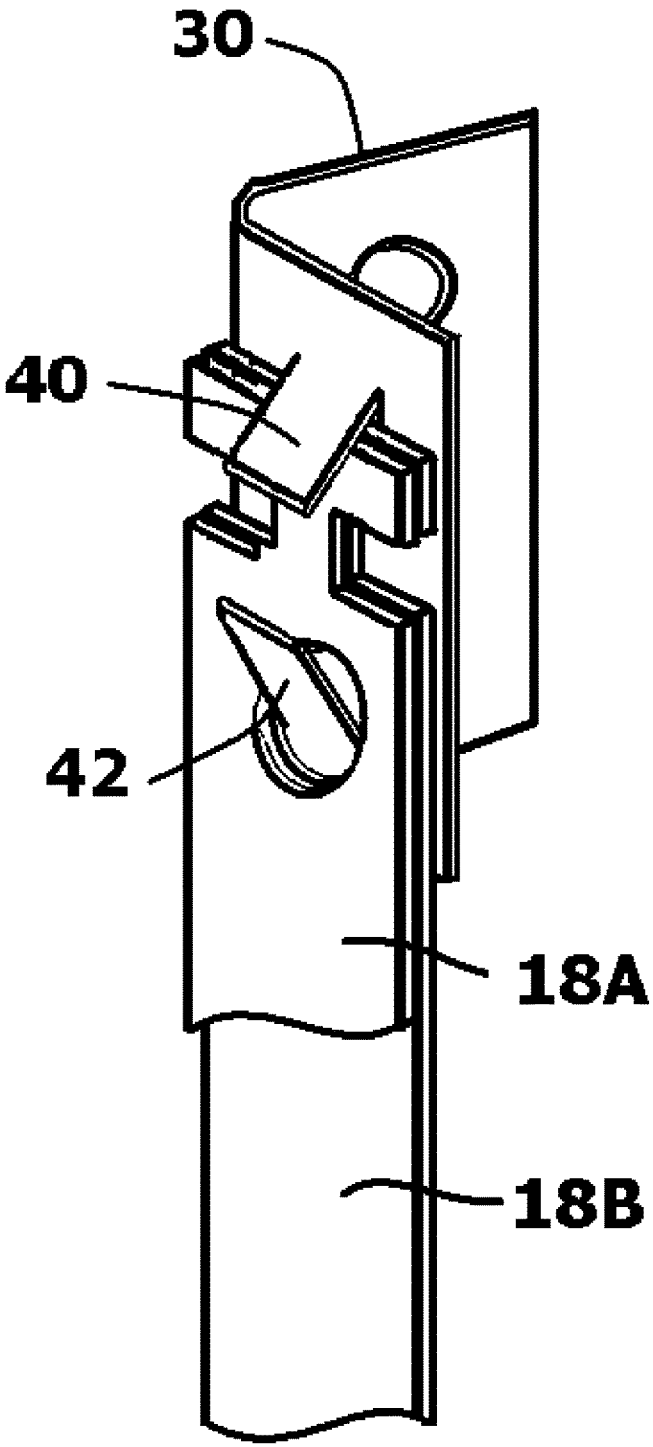
FIG. 6 shows the same matter as FIG. 5 with the anchor mount engaging the terminations of two coil springs.

Referring to FIG. 6, it can be seen that more than one coil spring 18A, 18B can be attached to the anchor mount 30. If the anchor mount 30 is intended to retain multiple coil springs, the lengths of the tabs 40, 42 can be adjusted accordingly. Each of the coil springs 18A, 18B is attached to the anchor mount 30 in the same manner using the manipulations previously described.

Figure 7:
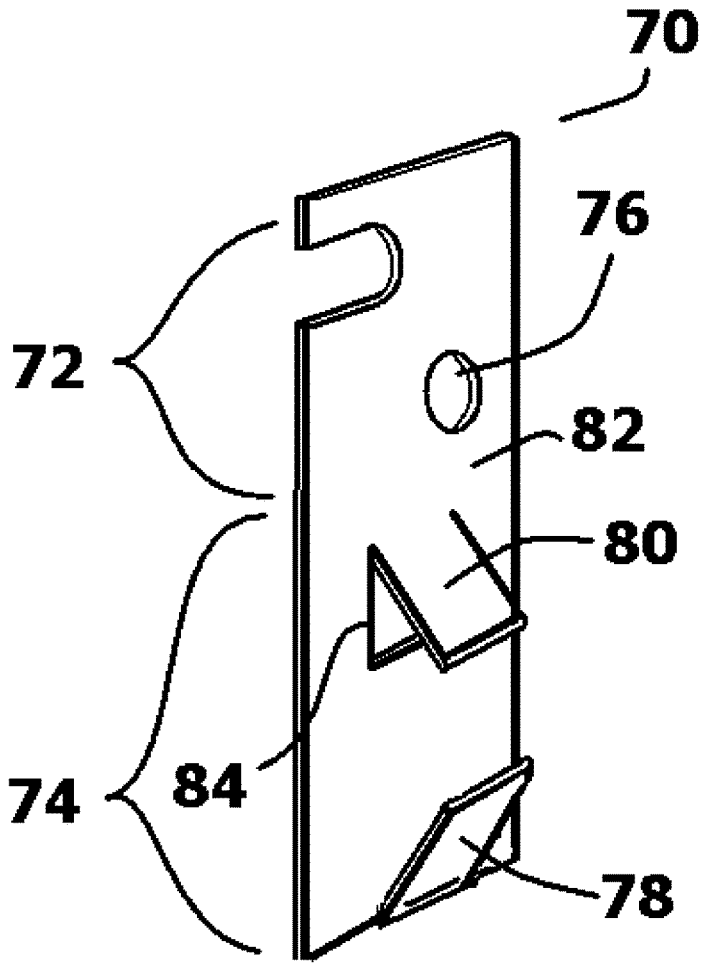
FIG. 7 shows an alternate embodiment of an anchor mount.

Referring to FIG. 7, an alternate embodiment of an anchor mount 70 is shown. In this embodiment, the anchor mount 70 has a first section 72 and a second section 74. As in the previous embodiment, at least one screw hole 76 is formed through the first section 72. Likewise, two tabs 78, 80 are formed on the second section 74. However, the first section 72 and the second section 74 are linearly aligned in a common plane along the same bracket body 82.

In this embodiment, it can also be seen that the first tab 78 can be formed in the end of the bracket body 82. Accordingly, only the second tab 80 need be formed by creating a U-shaped cut 84 in the bracket body 82. A coil spring will engage the two tabs 78, 80 in the same manner as was previously described.

It will be understood that the embodiments of the present invention described and illustrated are merely exemplary and that a person skilled in the art can make many variations to those embodiments. For instance, the size of the anchor mount and the height of the tabs can be varied to accommodate different coil spring designs. All such variations, modifications, and alternate embodiments are intended to be included within the scope of the present invention as defined by the claims.

What is claimed is:

1. An anchor mount for anchoring a free end of a ribbon coil spring to a guide track of a window, wherein the ribbon coil spring has an opening formed therethrough at a first distance from the free end, said anchor mount comprising:

a body having a first section and a second section;

at least one screw hole formed through said first section;

a first tab protruding from said second section of said body, wherein said first tab has a first base;

a second tab that protrudes from said second section of said body, wherein said second tab has a second base and said second tab is angled toward said first tab at an inclined angle; and wherein a second distance exists between said first base and said second base that is generally equal to said first distance.

2. The anchor mount according to claim 1, wherein said first section and said second section are perpendicular.

3. The anchor mount according to claim 2, wherein said first section and said second section are joined along a common bend in said body.

4. The anchor mount according to claim 1, wherein said first section and said second section are linearly aligned in a common plane.

5. The anchor mount according to claim 1, wherein said first tab is angled toward said second tab.

6. The anchor mount according to claim 1, wherein said first tab and said second tab are defined by generally U-shaped cuts in said second section, wherein said first tab and said second tab are part of said second section and are bent from said second section.

7. An anchoring system, comprising:

a ribbon coil spring having a free end and an opening formed therein a first distance from said free end;

an anchor mount having at least one screw hole formed therethrough;

a first tab protruding from said anchor mount, wherein said first tab has a first base;

a second tab protruding from said anchor mount, wherein said second tab has a second base and said second tab is angled toward said first tab at an inclined angle; and wherein said first tab extends through said opening in said ribbon coil spring and said free end of said ribbon coil spring is positioned proximate said second tab so that said second tab extends over said free end.

8. The system according to claim 7, wherein a second distance exists between said first base of said first tab and said second base of said second tab that is generally equal to said first distance along said ribbon coil spring.

9. The system according to claim 7, wherein said anchor mount has a first section and a second section, wherein said at least one screw hole is formed through said first section and both said first tab and said second tab protrude from said second section.

10. The system according to claim 9, wherein said first section and said second section are perpendicular.

11. The system according to claim 9, wherein said first section and said second section are joined along a common bend in said anchor mount.

12. The system according to claim 9, wherein said first section and said second section are linearly aligned in a common plane.

13. The system according to claim 7, wherein said first tab and said second tab are angled toward each other at equal angles of inclination.

14. The system according to claim 9, wherein said first tab and said second tab are defined by generally U-shaped cuts in said second section, wherein said first tab and said second tab are part of said second section and are bent from said second section.

15. The system according to claim 7, wherein said anchor mount is unistructurally formed from a single flat blank of metal.

16. A method of anchoring a free end of a coil spring to a guide track of a window, comprising the steps of:

providing a coil spring having a free end and an opening formed therein a first distance from said free end;

providing an anchor mount having both a first tab and a second tab protruding therefrom, wherein said second tab is angled toward said first tab at an inclined angle;

passing said first tab through said opening in said coil spring; and rotating said coil spring about said first tab until said free end of said coil spring passes under said second tab; and mounting the anchor mount to the guide track with a mechanical fastener.

17. The method according to claim 16, wherein providing an anchor mount includes providing an anchor mount with two perpendicular sections, wherein said first tab and said second tab protrude from a first of said two perpendicular sections.

18. The method according to claim 16, wherein providing an anchor mount includes forming said anchor mount by forming holes into, and bending, a flat blank of metal.

* * * * *